US011369133B2

(12) United States Patent
Boucher et al.

(10) Patent No.: US 11,369,133 B2
(45) Date of Patent: Jun. 28, 2022

(54) CONE FILLING APPARATUS AND RELATED METHODS

(71) Applicant: CANOPY GROWTH CORPORATION, Smiths Falls (CA)

(72) Inventors: Luc Boucher, Ottawa (CA); Torrin Mullins, Ottawa (CA); John Tutton, Manotick (CA); Robert Watters, Ottawa (CA)

(73) Assignee: CANOPY GROWTH CORPORATION, Smiths Falls (CA)

( * ) Notice: Subject to any disclaimer, the term of this patent is extended or adjusted under 35 U.S.C. 154(b) by 428 days.

(21) Appl. No.: 16/391,403

(22) Filed: Apr. 23, 2019

(65) Prior Publication Data

US 2019/0320707 A1 Oct. 24, 2019

Related U.S. Application Data

(60) Provisional application No. 62/810,010, filed on Feb. 25, 2019, provisional application No. 62/809,998, filed on Feb. 25, 2019, provisional application No. 62/661,348, filed on Apr. 23, 2018.

(51) Int. Cl.
*A24C 5/02* (2006.01)
*A24C 5/39* (2006.01)

(52) U.S. Cl.
CPC ..... *A24C 5/02* (2013.01); *A24C 5/393* (2013.01)

(58) Field of Classification Search
CPC ..... A24C 5/02; A24C 5/393; A24C 5/06
See application file for complete search history.

(56) References Cited

U.S. PATENT DOCUMENTS

| | | | | |
|---|---|---|---|---|
| 2,010,699 | A | 8/1935 | Pattee | |
| 4,442,848 | A * | 4/1984 | Seragnoli | B65G 47/19 131/108 |
| 5,159,939 | A * | 11/1992 | Marritt | A24C 5/18 131/109.1 |
| 9,574,922 | B2 | 2/2017 | Amiss | |
| 2013/0047996 | A1 | 2/2013 | Ryszard | |
| 2014/0263408 | A1* | 9/2014 | Amiss | B65B 1/363 222/1 |
| 2016/0120212 | A1 | 5/2016 | Heidtmann | |

FOREIGN PATENT DOCUMENTS

WO 2017/172844 A1 5/2017

OTHER PUBLICATIONS

International Search Report and Written Opinion issued in PCT/CA2019/050497, dated Jul. 12, 2019, 8 pages.

* cited by examiner

*Primary Examiner* — Eric Yaary
*Assistant Examiner* — Jennifer A Kessie
(74) *Attorney, Agent, or Firm* — Stinson LLP

(57) ABSTRACT

A cone filling apparatus for production of smoking articles includes: (a) a cone pallet including a plurality of cavities, each cavity for holding a respective cone; (b) a delivery chute having a load end for receiving a smokeable product from a source and an unload end downstream of the load end for unloading the smokeable product from the chute; and (c) a dosing tray disposed above the pallet. The dosing tray includes a plurality of transfer sleeves. Each sleeve has an upper sleeve end for receiving smokeable product unloaded from the unload end of the chute, and a lower sleeve end for dispensing the smokeable product into a cone held in a respective cavity aligned beneath the lower sleeve end.

36 Claims, 10 Drawing Sheets

CONE FILLING APPARATUS AND RELATED METHODS

CROSS-REFERENCE TO RELATED APPLICATIONS

This application is based on and claims priority to U.S. Provisional Application Ser. No. 62/661,348 filed Apr. 23, 2018; U.S. Provisional Application Ser. No. 62/809,998 filed Feb. 25, 2019; and U.S. Provisional Application Ser. No. 62/810,010 filed Feb. 25, 2019, each of which is incorporated herein by reference in its entirety.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The specification relates generally to production of smoking articles, and more specifically, to apparatuses and methods for filling cones in production of conical smoking articles.

2. Description of Related Art

Int. Pub. No. WO 2017/172844 A1 discloses an apparatus including a holder plate and a carriage assembly. The holder plate includes a plurality of through-holes configured to receive containers having an interior cavity. The carriage assembly comprises one or more carriage plates and tamper rods, the carriage plates having a plurality of through-holes. Each of the tamper rods can be slidably disposed in a respective one of the plurality of through-holes of the carriage plate. Each of the tamper rods can be independently weighted to provide a force independent of the other of the tamper rods and can be independently movable relative to the other of the tamper rods. The carriage assembly can be configured to be aligned with the holder plate such that the each of the tamper rods provides a compressive force to a filler material within the interior cavity of each of the containers.

U.S. Pat. App. Pub. No. 2016/0120212 A1 discloses a tube filling apparatus. The apparatus includes a base and a filling assembly mountable on the base. The filling assembly has a number of tube receiving recesses wherein tubes may, in use, be received. The apparatus further includes a vibration plate which is locatable between the base and the filling assembly. In use, the tubes rest on the vibration plate when they are located in the recesses. The apparatus also includes vibrating means which is connected to the vibration plate for, in use, vibrating the vibration plate, which is capable of moving independently from the filling assembly.

BRIEF SUMMARY OF THE INVENTION

The following summary is intended to introduce the reader to various aspects of the applicant's teaching, but not to define any invention.

According to some aspects, a cone filling apparatus for production of smoking articles includes: (a) a cone pallet including a plurality of cavities, each cavity for holding a respective cone; (b) a delivery chute having a load end for receiving a smokeable product from a source and an unload end downstream of the load end for unloading the smokeable product from the chute; and (c) a dosing tray disposed above the pallet. The dosing tray includes a plurality of transfer sleeves. Each sleeve has an upper sleeve end for receiving smokeable product unloaded from the unload end of the chute, and a lower sleeve end for dispensing the smokeable product into a cone held in a respective cavity aligned beneath the lower sleeve end.

In some examples, the chute is configured to provide a controlled flow of the smokeable product to the dosing tray.

In some examples, chute includes an inner chute surface for conveying the smokeable product, and a plurality of prongs adjacent the inner chute surface for inhibiting consolidation of the smokeable product.

In some examples, the load end is at an elevation greater than the unload end to facilitate transport of smokeable product along the chute by gravitational force.

In some examples, the chute includes at least a first chute segment and a second chute segment downstream of the first chute segment. The first chute segment includes the load end and the second chute segment includes the unload end. In some examples, the chute includes a third chute segment intermediate the first chute segment and the second chute segment. The third chute segment has a third segment upstream end for receiving product from the first chute segment and a third segment downstream end for delivering product to the second chute segment. In some examples, one of the chute segments is inclined at a first angle from the horizontal and another one of the chute segments is inclined at a second angle from the horizontal. The second angle is different from the first angle.

In some examples, the chute is sized to receive one batch amount of the smokeable product. The batch amount is equal to an amount of product required to fill all the cones in the cone pallet.

In some examples, the chute is configured to preferentially advance product granules by size. In some examples, the chute is configured to advance larger granules ahead of smaller granules.

In some examples, the apparatus includes a vibratory drive operable to urge vibration of the chute. In some examples, the vibratory drive has an adjustable frequency and amplitude. The frequency and amplitude are tunable to facilitate a desired flow rate and preferential advancement of the smokeable product based on granule size along the chute.

In some examples, the plurality of transfer sleeves and the plurality of cavities are of equal quantity.

In some examples, the dosing tray includes a collection chamber above the transfer sleeves for receiving the product from the unload end of the chute and facilitating dispersion of the product among the transfer sleeves.

In some examples, the lower ends of the transfer sleeves are simultaneously aligned with open upper ends of the respective cavities.

In some examples, each of the plurality of cavities and the plurality of transfer sleeves are arranged about a vertical axis in a circular array, and the apparatus includes a rotary drive for rotating the dosing tray about the vertical axis. In some examples, the cone pallet is releasably coupled to the dosing tray to rotate with the dosing tray and maintain alignment of the transfer sleeves and the cavities. In some examples, rotation of the dosing tray is synchronized with a rate at which product is dispensed from the unload end of the chute such that the dosing tray rotates an integer multiple of times while receiving one batch of the smokeable product from the unload end. The one batch is equal to an amount of product required to fill all the cones in the cone pallet.

According to some aspects, a method of production of smoking articles includes: (a) positioning a plurality of cones in respective cavities of a cone pallet; (b) positioning the cone pallet under a dosing tray; (c) conveying a smokeable product along a chute toward an unload end of the chute, the unload end positioned above the dosing tray; and (d) unloading the smokeable product from the unload end of the chute and into the cones through a plurality of transfer sleeves of the dosing tray.

In some examples, step (c) includes controllably flowing the smokeable product along the chute to the unload end.

In some examples, step (c) includes conveying the smokeable product along the chute at least in part by gravitational force.

In some examples, the method further includes loading the chute with one batch amount of the smokeable product and unloading the batch amount from the unload end in step (d) prior to loading a subsequent batch amount on the chute. The batch amount is equal to an amount of smokeable product required to fill all the cones in the cone pallet.

In some examples, step (c) includes preferentially advancing granules of the smokeable product based on granule size. In some examples, step (c) includes advancing larger granules ahead of smaller granules. In some examples, step (c) includes imparting vibrations on the chute. In some examples, the method further includes adjusting at least one of an amplitude and a frequency of the vibrations to facilitate a desired flow rate and preferential advancement of the smokeable product based on granule size.

In some examples, step (c) includes conveying the smokeable product along a plurality of chute segments of the chute, and the method further includes vibrating a first one of the chute segments at a first frequency and a first amplitude, and vibrating a second one of the chute segments at a second frequency and a second amplitude. In some examples, at least one of (i) the second frequency is different from the first frequency and (ii) the second amplitude is different from the first amplitude.

In some examples, each of the cavities and the transfer sleeves are arranged about a vertical axis in a circular array, and the method further includes, during step (d), rotating the dosing tray and the cavity pallet about the vertical axis to facilitate generally equal dispersion of the smokeable product among the cavities.

In some examples, the method further includes synchronizing rotation of the dosing tray and the cavity pallet with a rate at which the smokeable product is unloaded from the chute such that the dosing tray rotates an integer multiple of times while receiving one batch amount of the smokeable product from the unload end of the chute. The batch amount is equal to an amount of smokeable product required to fill all the cones in the cone pallet.

In some examples, step (d) includes: (i) partially filling the first cone with a first amount of the smokeable product, (ii), after (i), partially filling a second cone with the smokeable product, and (iii), after (ii), depositing a second amount of the smokeable product into the first cone on top of the first amount.

In some examples, the first amount of the smokeable product has a first average granule size, and the second amount of the smokeable product has a second average granule size. The second average granule size is smaller than the first average granule size.

In some examples, the method further includes, after step (d), compacting the smokeable product in the cones. In some examples, the method further includes, prior to the compacting step, moving the cone pallet from under the dosing tray to a compaction station.

In some examples, the method further includes, after step (d), twisting an upper portion of each cone to close the cones. In some examples, the method further includes, prior to the twisting step, moving the cone pallet to a cone closure station.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION OF PREFERRED EMBODIMENT

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
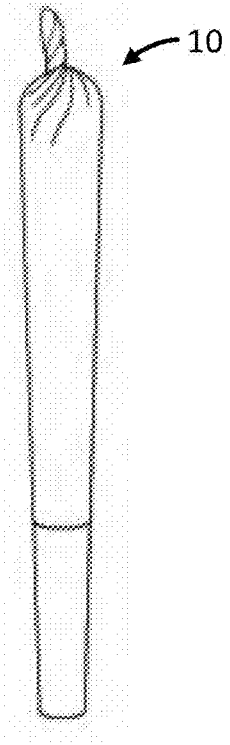
FIG. 1 is a perspective view of an example conical smoking article.

Smoking articles having a conical shape, like that of the example smoking article 10 shown in FIG. 1, are popular among a variety of users, including, for example, cannabis users. Smoking articles having a conical shape are typically hand-made, or otherwise produced in small, labor-intensive batches. In contrast, cylindrical smoking articles, such as traditional tobacco cigarettes, are often manufactured in high volume production systems with a high degree of sophisticated automation. But the difference in shape, among other reasons, can render the processes and apparatus of such automated systems inapplicable to conically shaped smoking articles such as the article 10.

Figure 2A:
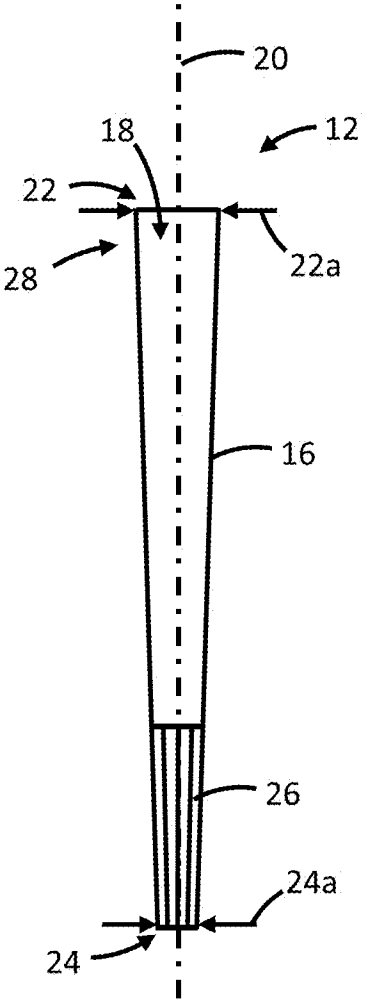
FIG. 2A is a cross-sectional view of the cone of FIG. 2, taken along line 2A-2A of FIG. 2.
Figure 2:
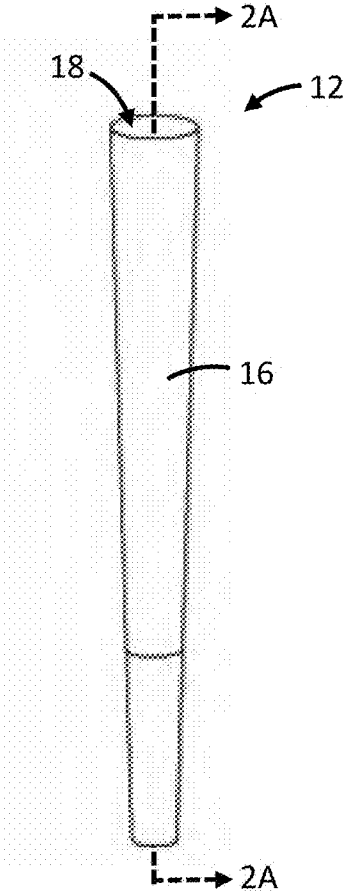
FIG. 2 is a perspective view of an example cone for manufacture of the smoking article of FIG. 1.

Referring to FIGS. 1 and 2, in the example illustrated, the example smoking article 10 is formed using a cone 12. The cone 12 is formed of a smokeable wrapper 16 having a cone cavity 18 for receiving and containing a smokeable product. In the example illustrated, the wrapper 16 is generally air impermeable, and the smokeable product is a granular product. In some examples, the cone 12 can be preassembled and the cone cavity 18 can be subsequently filled with the smokeable product. The smokeable product can be prepared via chopping, grinding, and/or sifting of a bulk smoking material. The bulk smoking material can include, for example, dried cannabis plant material, and the smokeable product can include cannabis granules. The smokeable product can include a mix of cannabis types or strains. The smokeable can include a mix of different types of smokeable products such as cannabis and tobacco.

Referring to FIG. 2A, in the example illustrated, the cone cavity 18 extends along a cone cavity axis 20 between an upper end 22 and a lower end 24 opposite the upper end 22. In the example illustrated, the wrapper 16 has an upper end diameter 22*a* at the upper end 22 of the cavity 18 and a lower end diameter 24*a* at the lower end 24 of the cavity 18. The lower end diameter 24*a* is smaller than the upper end diameter 22*a*, and the wrapper 16 tapers radially inwardly along the cavity axis 20 from the upper end diameter 22*a* to the lower end diameter 24*a* to provide the cone 12 with a generally conical shape. In the example illustrated in FIG. 2A, the upper end 22 of the cavity 18 is open for permitting filling of the cavity 18 with the smokeable product. In the example illustrated, the cone 12 includes a filter 26 in the cavity 18 adjacent the lower end 24. The filter 26 can help to provide structural stability to the smoking article 10, and can help inhibit smokeable product in the cavity 18 from escaping through the lower end 24.

Figure 3:
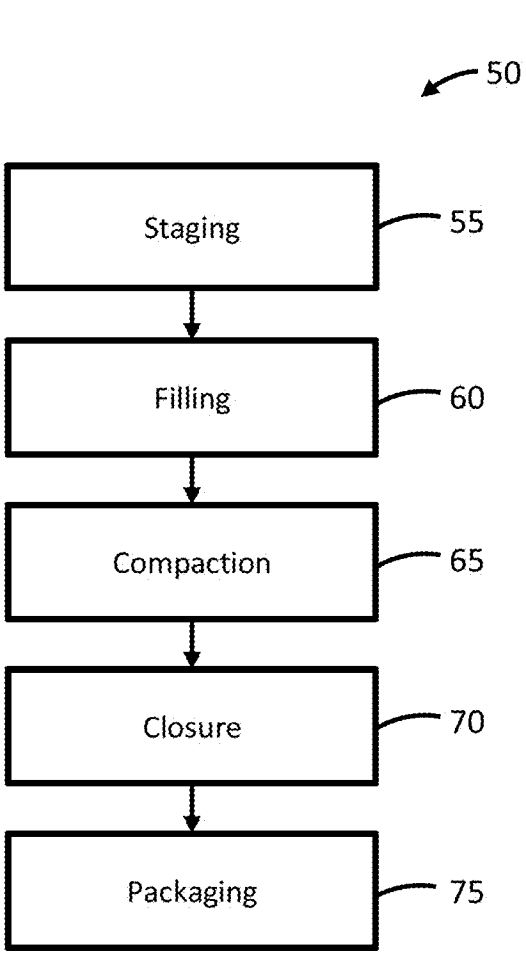
FIG. 3 is a flow chart showing an example process for production of conical smoking articles like that of FIG. 1.

Referring to FIG. 3, an example process 50 for production of conical smoking articles is shown, and will be described with respect to the example smoking article 10.

At step 55 of the process 50, a plurality of the cones 12 are staged for filling with the smokeable product. The cones 12 can be staged by, for example, being positioned in a pallet with the open upper ends 22 directed upwardly for receiving the smokeable product.

At step 60, the staged cones 12 can be filled with the smokeable product through respective open upper ends 22 of each cone 12. The cones 12 can be filled while held in the pallet. The cones 12 can be filled with the smokeable product using filling apparatuses and methods like those described in more detail below with respect to FIGS. 4 to 13.

At step 65, the smokeable product in the cones 12 is compacted. The smokeable product can be compacted while the cones 12 are held in the pallet. Compaction can be through the means of vibration energy transferred to the fill material in the cones. Compaction can be through the use of mechanical devices acting on the fill material in the cone.

At step 70, in the example illustrated, an upper portion 28 of each wrapper 16 is twisted to close the upper end 22 of the cavity 18 for inhibiting the granule product from escaping from the cavity 18, and to form the smoking article 10. At step 75, the smoking articles 10 can be packaged for shipment and/or sale.

Figure 4:
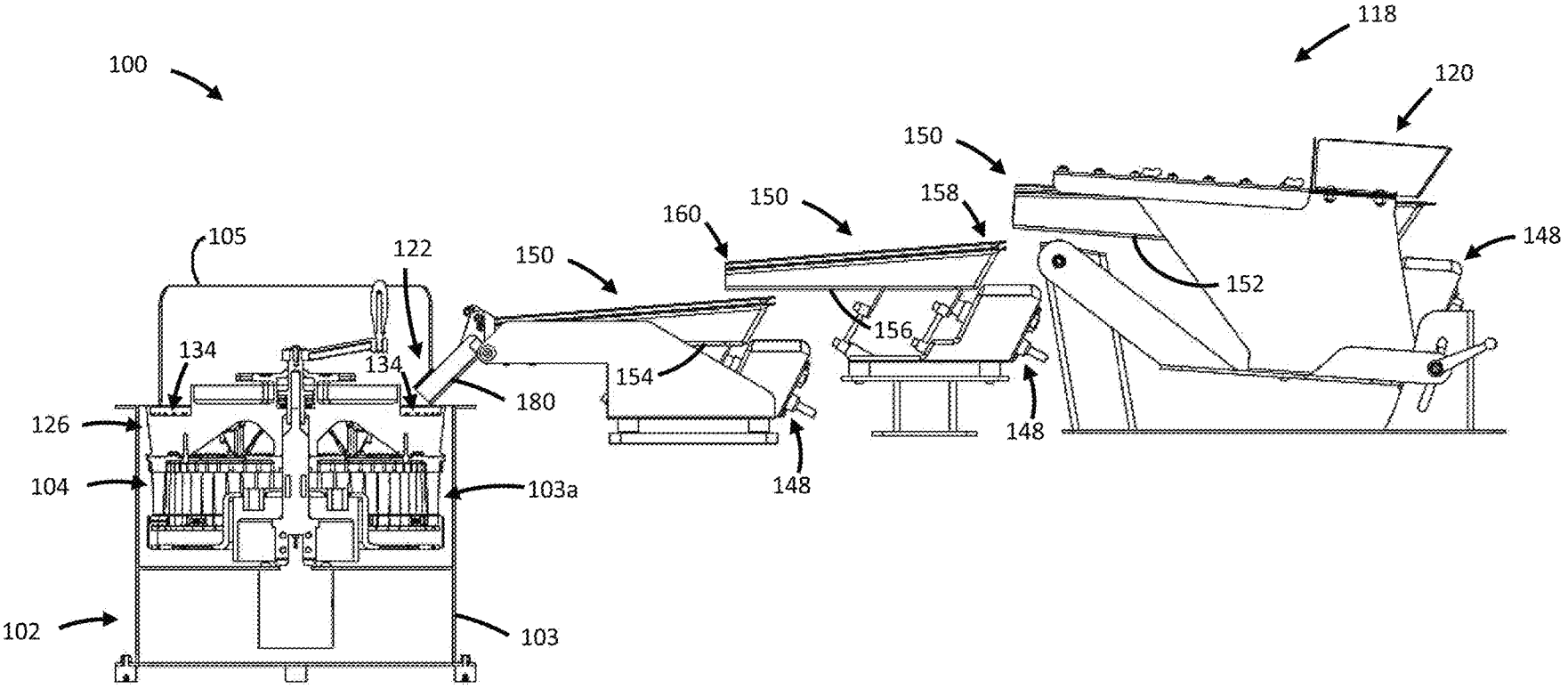
FIG. 4 is a schematic elevation view of an example cone filling apparatus for use with the process of FIG. 3.

Referring to FIG. 4, an example cone filling apparatus 100 for use during the cone filling step 60 is shown, and will be described with respect to the example cone 12 of FIG. 2.

In the example illustrated, the cone filling apparatus 100 includes a frame 102 and a cone pallet 104 releasably supported by the frame 102. In the example illustrated, the frame 102 includes a housing 103 and a chamber 103*a* in the housing 103. At least a portion of the cone pallet 104 is received in the chamber 103*a* when supported by the frame 102.

Figure 6:
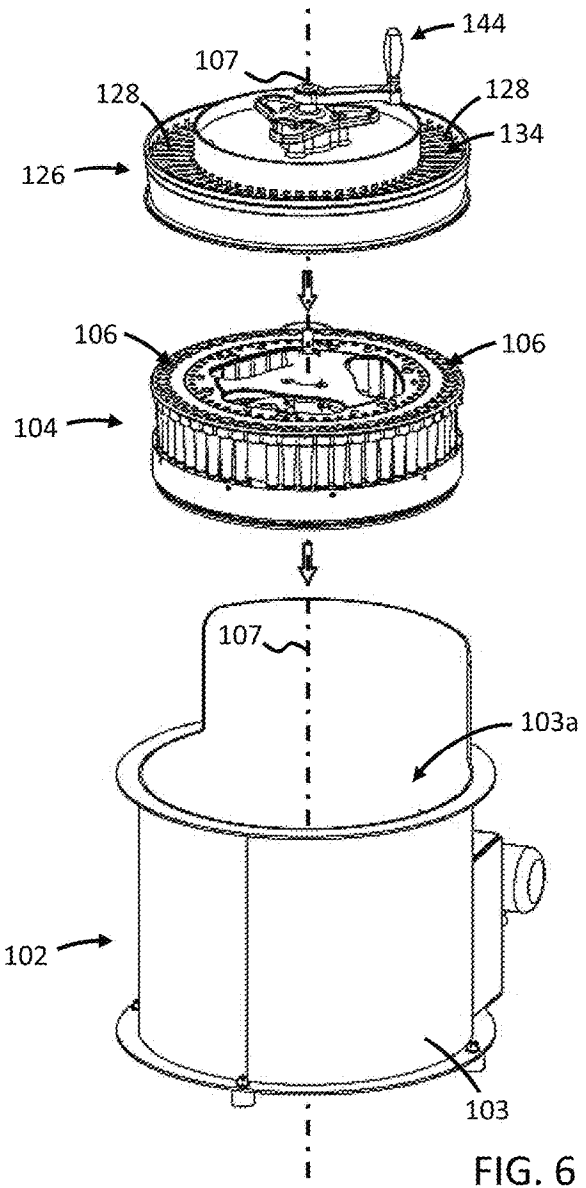
FIG. 6 is a partially exploded view of the dosing portion of FIG. 5.
Figure 5:
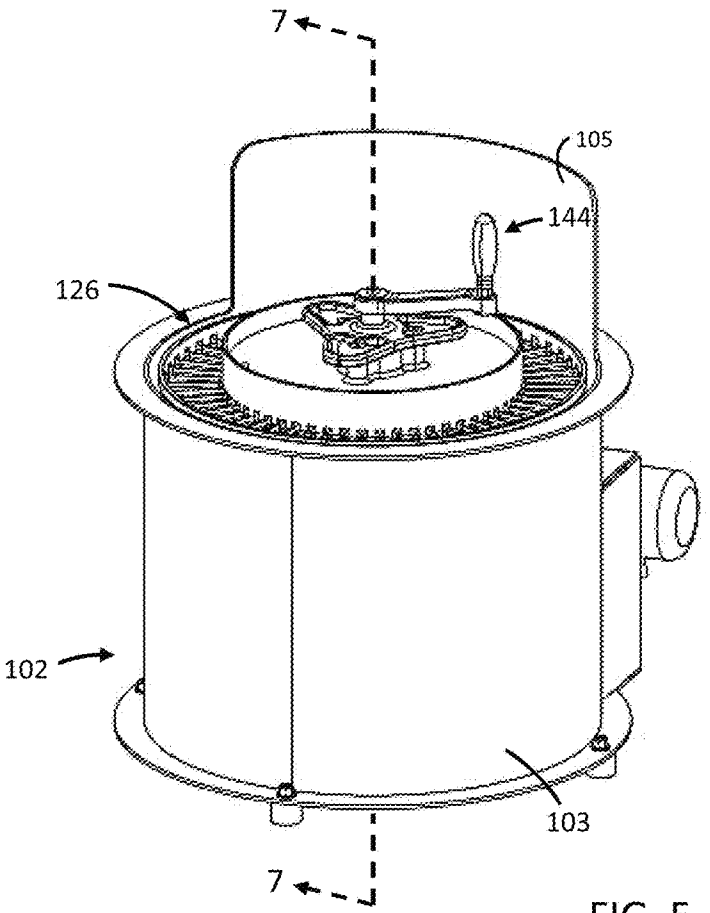
FIG. 5 is a perspective view of a dosing portion of the apparatus of FIG. 4.

Referring to FIG. 6, in the example illustrated, the cone pallet 104 includes a plurality of pallet cavities 106. Each pallet cavity 106 is arranged for holding a respective cone 12, with the open upper end 22 of the cones 12 directed upwardly for receiving the smokeable product.

Figure 7:
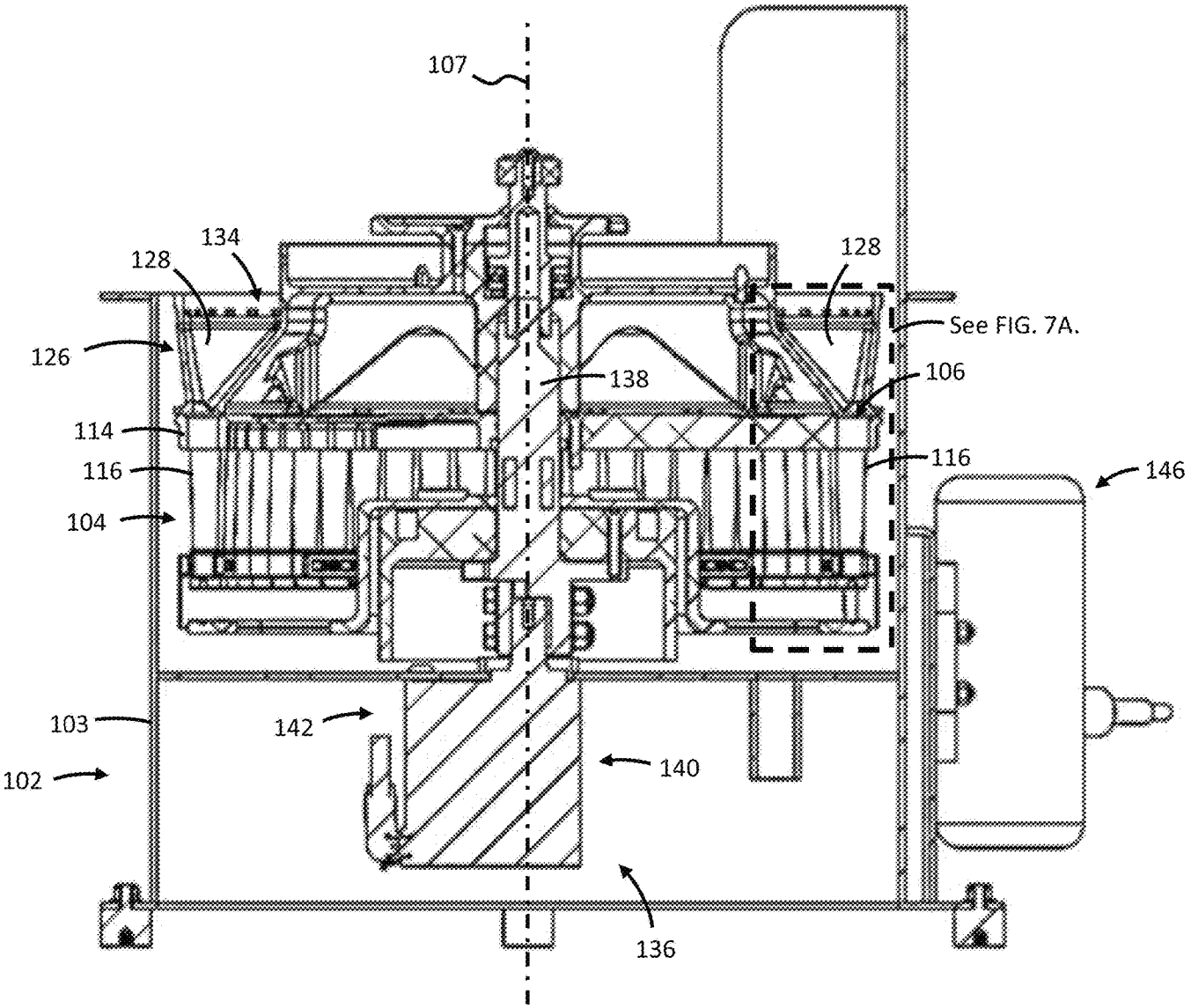
FIG. 7 is a cross-sectional view of the dosing portion of FIG. 5, taken along line 7-7 of FIG. 5.
Figure 7B:
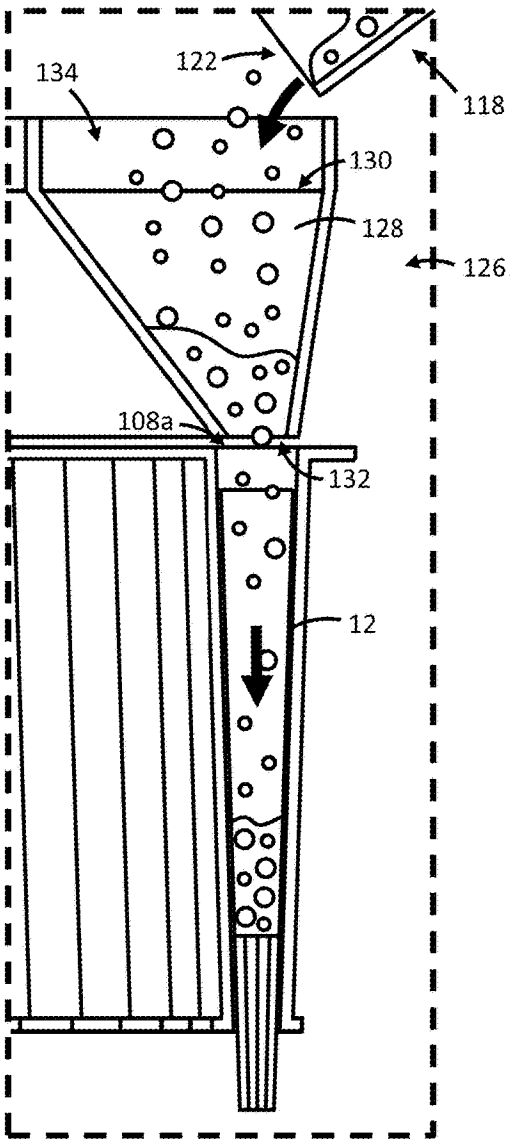
FIG. 7B is a schematic representation like that of FIG. 7A, but showing a cone received in the pallet portion and being filled with a smokeable product.
Figure 7A:
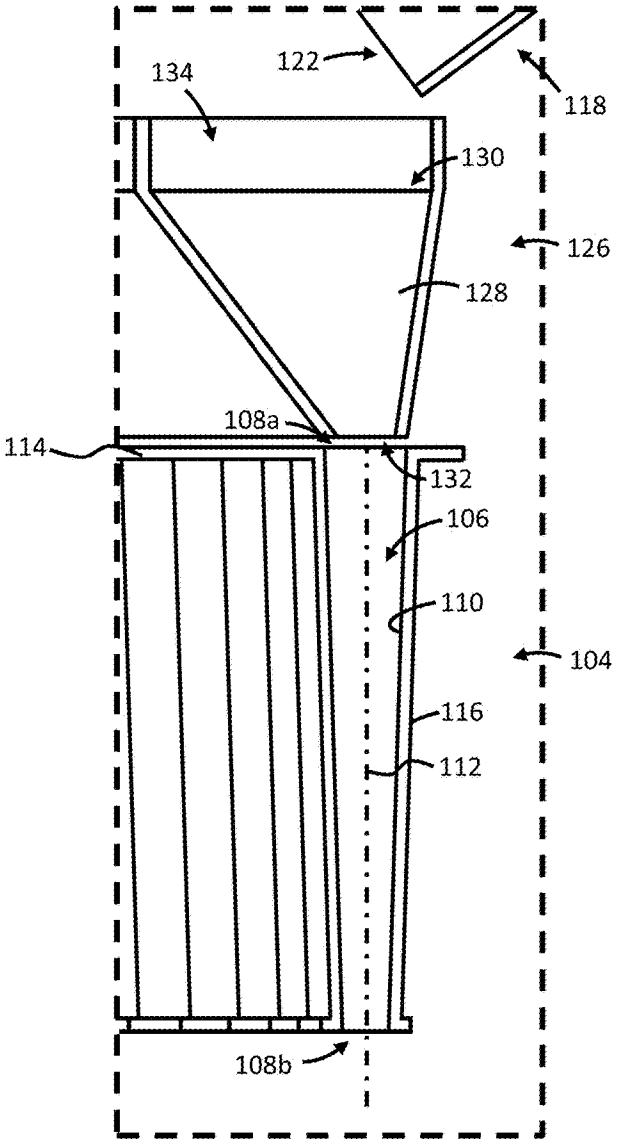
FIG. 7A is a schematic cross-sectional representation of a portion of FIG. 7, showing pallet and tray portions of the apparatus of FIG. 4.

Referring to FIG. 7A, each pallet cavity 106 is defined by an inner surface 110 extending along a pallet cavity axis 112 between an open upper end 108*a* for receiving a cone 12 and a lower end 108*b* opposite the upper end 108*a*. In the example illustrated, the inner surface 110 tapers radially inwardly along the axis 112 from the upper end 108*a* toward the lower end 108*b* to provide the inner surface 110 with a generally conical shape corresponding to that of at least a portion of the cone 12. In the example illustrated, the pallet 104 has a pallet body 114, and the pallet cavities 106 are provided in respective nests 116 attached to the pallet body 114. In the schematic example of FIG. 7A, the nests 116 are shown as being of unitary, integral, one-piece construction with the pallet body 114. In some examples, the nests 116 can be removably secured to the pallet body 114. In some embodiments the removable nests allow for reconfiguration, where they are replaceable to allow the use of larger, smaller or differently shaped cones.

Referring to FIG. 4, in the example illustrated, the apparatus 100 further includes a delivery chute 118 having a load end 120 for receiving the smokeable product from a source and an unload end 122 downstream of the load end 120 for unloading the smokeable product from the chute 118.

In the example illustrated, the apparatus 100 further includes a dosing tray 126 disposed above the pallet 104. Referring to FIG. 6, the dosing tray 126 comprises a plurality of transfer sleeves 128. Referring to FIGS. 7A and 7B, each transfer sleeve 128 has an upper sleeve end 130 for receiving smokeable product unloaded from the unload end 122 of the chute 118, and a lower sleeve end 132 for dispensing the smokeable product into a respective cone 12 held in a respective pallet cavity 106 and aligned beneath the lower sleeve end 132. Referring again to FIGS. 4 and 5, in the example illustrated, the frame 102 includes a wind baffle 105 extending upward from an upper end of the body 103 to help reduce drafts or other air currents above the dosing tray 126 and in proximity to the unload end 122 of the delivery chute 118.

In the example illustrated, the lower sleeve ends 132 of the transfer sleeves 128 are simultaneously aligned with open upper ends 108*a* of the respective pallet cavities 106. Referring to FIG. 6, in the example illustrated, the plurality of transfer sleeves 128 and the plurality of pallet cavities 106 are of equal quantity. In the example illustrated, the dosing tray 126 includes fifty-four (54) transfer sleeves 128 and the pallet 104 includes fifty-four (54) pallet cavities 106. In the example illustrated, each of the plurality of pallet cavities 106 and the plurality of transfer sleeves 128 is arranged in a circular array about a vertical axis 107 (see also FIG. 7).

In the example illustrated, the dosing tray 126 includes a collection chamber 134 open to the transfer sleeves 128. The collection chamber 134 is open to multiple transfer sleeves 128, and in the example illustrated, is a single chamber open to all of the transfer sleeves 128. The collection chamber 134 is arranged for receiving the smokeable product from the unload end 122 of the chute 118 (FIG. 4) and facilitating dispersion of the smokeable product among the transfer sleeves 128. In the example illustrated, the collection chamber 134 is generally annular and extends about the axis 107.

Referring to FIG. 7, in the example illustrated, the apparatus 100 includes a shuttle mechanism 136 for moving the transfer sleeves 128 toward and away from the unload end 122 of the chute 118. In the example illustrated, the shuttle mechanism 136 comprises a rotary drive 140 for rotating the dosing tray 126 about the vertical axis 107. In the example illustrated, the cone pallet 104 is releasably coupled to the dosing tray 126 to rotate therewith and maintain alignment of the transfer sleeves 128 and the pallet cavities 106. Rotation of the dosing tray 126 can be synchronized with a rate at which product is dispensed from the unload end 122 of the chute 118 (FIG. 4) such that the dosing tray 126 rotates an integer multiple of times while receiving one batch of the smokeable product from the unload end 122. The one batch can be equal to an amount of product required to fill all the cones 12 held in the pallet cavities 106 of the cone pallet 104.

In some cases, it may be desirable to fill each cone with a precise amount of smokeable product based on weight. The nominal precise amount defines a target weight of smokeable product. The fill amount during production could be, for example, the target weight +/− 10%, or +/− 5%. Sometimes a tolerance of minus 0% and plus 5% is desired. Other products may require minus 0% to plus 10% of the target weight. The target weight may be the label weight (e.g. the sale weight). In some examples, the target weight for a single cone may be set so that a maximum permitted amount, for example, 1.0 g per single cone, is not exceeded. In some examples, the target weight is 0.95 g+/− 0.05 g. In some examples, the target weight is 0.5 g or 0.33 g, with a tolerance of +/− 10%.

In the example illustrated, the shuttle mechanism 136 comprises a drive shaft 138 rotatably supported by the frame 102 and extending along the vertical axis 107. Each of the pallet 104 and the dosing tray 126 are removably mounted to the drive shaft 138 for rotation therewith. The drive shaft 138, the pallet 104, and/or the dosing tray 126 can include complementary engagement features to facilitate alignment of the lower sleeve ends 132 with respective pallet cavities 106 when the pallet 104 and the dosing tray 126 are mounted to the drive shaft 138, and for rotationally locking the pallet 104 and dosing tray 126 to the drive shaft 138. The engagement features can include, for example, complementary engagement surfaces, keys, locating pins, etc. The rotary drive 140 drives rotation of the drive shaft 138 (and the pallet 104 and dosing tray 126) about the vertical axis 107. The rotary drive 140 can include, for example, a motor and/or a manual crank coupled to the drive shaft 138. In the example illustrated, the rotary drive 140 includes a motor 142 in the housing 103 below the pallet 104.

In the example illustrated, the apparatus further includes a tightening device for tightening the connection between the dosing tray 126 and the cone pallet 104. In the example illustrated, the tightening device includes a hand crank 144 (FIG. 6) above the dosing tray 126 and coupled to a threaded rod anchored to the frame 102 and passing upwardly through the cone pallet 104.

Still referring to FIG. 7, in the example illustrated, the apparatus 100 includes one or more frame vibratory drives 146 coupled to the frame 102 for vibrating the pallet 104 and the dosing tray 126 to facilitate movement of the smokeable product through the sleeves 128, and settlement of the smokeable product in the cones 12 held in the pallet 104. In some examples, two or more vibratory drives can be mounted to the frame 102. Each drive can direct vibratory energy along a respective vibratory axis. In some examples, the vibratory axes of the drives can be oriented at various angles relative to each other, such as a generally perpendicular configuration. In some examples, one of the vibratory axes can be oriented generally horizontally, and another one of the vibratory axes can be oriented generally vertically. Vibratory energy can be imparted along one vibratory axis simultaneously with that of one or more other axes, or the amount and timing of vibratory energy imparted along the vibratory axes can be offset and/or adjusted to help encourage flow of smokeable product into the cones.

Referring to FIG. 4, in the example illustrated, the chute 118 is configured to provide a controlled flow of the smokeable product to the dosing tray 126. The chute 118 can be sized to receive one batch amount of the smokeable product, which can be equal to an amount of product required to fill all the cones 12 held in pallet cavities 106 of the cone pallet 104. In the example illustrated, the load end 120 of the chute 118 is at an elevation higher than the unload end 122 to facilitate controlled transport of smokeable product along the chute 118 by gravitational force.

In the example illustrated, the apparatus 100 includes one or more chute vibratory drives 148 operable to urge vibration of at least a portion of the chute 118 to facilitate movement of the smokeable product along the chute 118. In the example illustrated, the chute 118 is configured to preferentially advance product granules by size. In some examples, the chute 118 is configured to advance larger granules ahead of smaller granules. In the example illustrated, the chute vibratory drive 148 has an adjustable frequency and amplitude, and the frequency and amplitude is tunable to facilitate a desired flow rate and/or preferential advancement of the smokeable product based on granule size along the chute 118.

In the example illustrated, the chute 118 comprises a plurality of chute segments 150 including at least a first chute segment 152 and a second chute segment 154 downstream of the first chute segment 152. The first chute segment 152 includes the load end 120 of the chute 118 and the second chute segment 154 includes the unload end 122 of the chute 118. In the example illustrated, the chute segments 150 further include a third chute segment 156 intermediate the first chute segment 152 and the second chute segment 154. The third chute segment 156 has a third segment upstream end 158 for receiving product from the first chute segment 152 and a third segment downstream end 160 for delivering product to the second chute segment 154. In the example illustrated, a chute vibratory drive 148 is coupled to each chute segment 150. Each chute vibratory drive 148 can have an adjustable frequency and amplitude to vary the flow rate and/or preferential advancement characteristics of a respective chute segment 150. In the example illustrated, each chute drive has a vibration frequency in a range of about 3300 vpm (vibrations per minute) to about 4000 vpm. The amplitude of the drive 148 coupled to the first chute segment 152 is adjusted to about 1.5 mm, the amplitude of the drive 148 coupled to the second chute segment 154 is adjusted to about 3 mm, and the amplitude of the drive 148 coupled to the third (intermediate) chute segment 156 is adjusted to an amount between the amplitudes of the first and second drives, for example, in a range of about 2 mm to about 2.5 mm.

Figure 8:
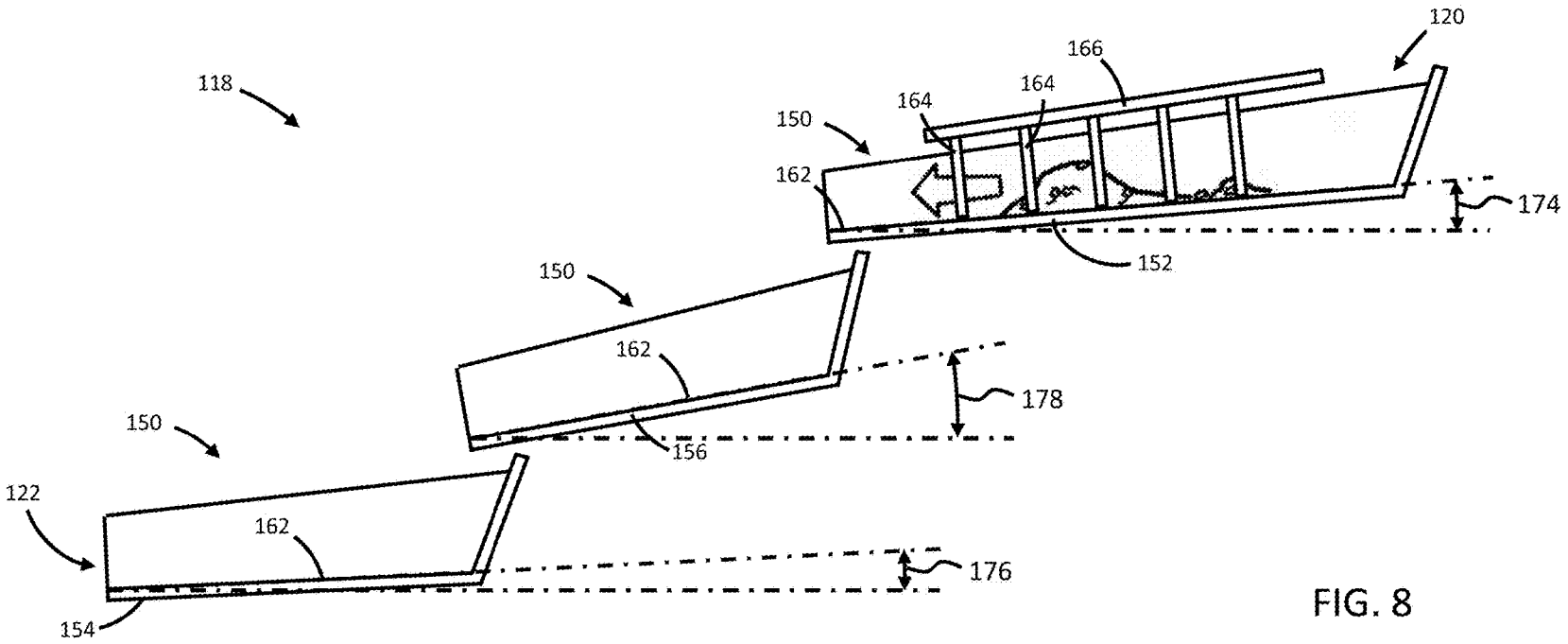
FIG. 8 is a schematic elevation view of chute segments of the apparatus of FIG. 4.

Referring to FIG. 8, in the example illustrated, each chute segment 150 comprises an inner chute surface 162 along which the smokeable product is conveyed. In the example illustrated, a plurality of prongs 164 (see also FIG. 9) are positioned adjacent the inner chute surface 162 of at least one of the chute segments 150 for inhibiting consolidation of the smokeable product. In the example illustrated, the prongs 164 are provided adjacent the inner chute surface 162 of the first chute segment 152. In the example illustrated, a prong frame 166 is mounted over a portion of the first chute segment 152, and the prongs 164 extend downwardly from the prong frame 166 toward the inner chute surface 162. The spacing and pattern of the prongs 164 may be selected and/or adjusted to vary a flow rate and/or to facilitate filtering of the smokeable product based on granule size. In some examples, the prongs 164 may be provided on and extend upwardly from the inner chute surface 162

Figure 8A:
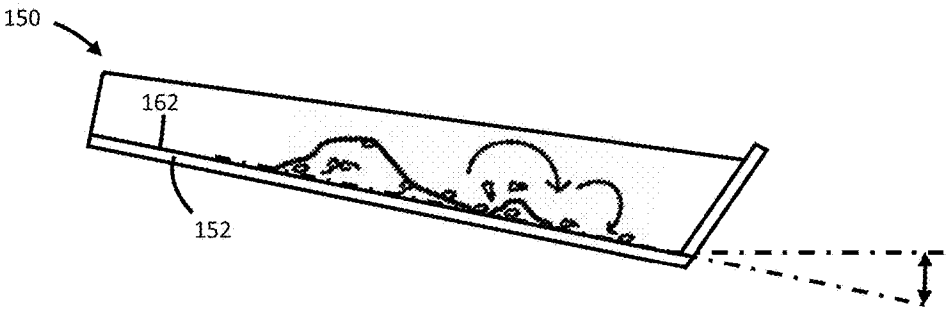
FIG. 8A is a schematic elevation view of one of the chute segments of FIG. 8, shown in a declined position.
Figure 9:
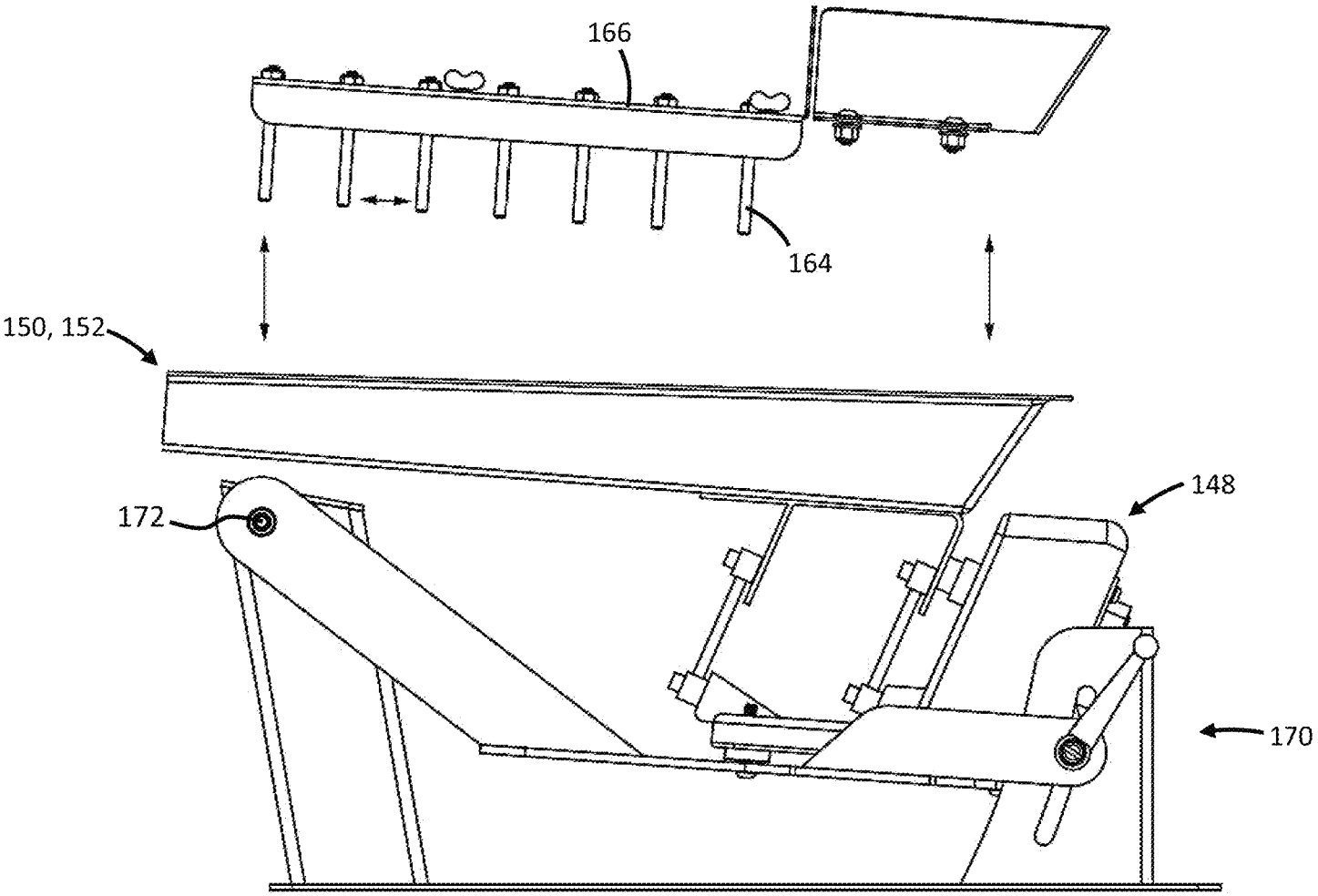
FIG. 9 is a partially exploded view of a chute segment of the apparatus of FIG. 4.

Referring to FIG. 9, in the example illustrated, at least one of the chute segments 150 is pivotably mounted on a respective chute base 170 for pivoting about a pivot axis 172 to adjust a pitch of the chute segment 150. This can help to, for example, adjust a flow rate and/or induce backslide of the smokeable product along the chute segment 150, and/or help determine the granule size for preferential advancement. In the example illustrated, at least the first chute segment 152 is pivotable about a respective pivot axis 172 for adjusting the pitch of the first chute segment 152. Referring to FIGS. 8 and 8A, in the example illustrated, the first chute segment 152 is pivotable between at least one inclined position (shown in FIG. 8) for advancing the smokeable product toward the dosing tray 126, and at least one declined position (shown in FIGS. 8A and 9) for inducing backslide of at least some of the smokeable product. In some cases, inducing backslide can help to, for example, break up clumps of the smokeable product and/or facilitate subsequent preferential advancement of a select granule size.

Referring to FIG. 8, in some examples, a first one of the chute segments 150 (e.g. the first chute segment 152) can be inclined at a first angle 174 from the horizontal and a second one of the chute segments 150 (e.g. the second chute segment 154) can be inclined at a second angle 176 from the horizontal. The second angle 176 can be different from the first angle 174. This can help to, for example, convey the smokeable product at a first rate along the first one of the chute segments 150 and at a second rate different from the first rate along the second one of the chute segments 150. In some examples, a third one of the chute segments 150 (e.g. the third chute segment 156) can be inclined at a third angle 178 from the horizontal that is different from the first and second angles 174, 176. The first, second, and/or third angles 174, 176, 178 can be adjustable via pivoting of the respective chute segments 150 about respective pivot axes.

The dosing tray, shuttle mechanism, adjustable chutes, and/or adjustable vibratory drives of the apparatus 100 can help achieve, for example, homogeneity, uniform volume, uniform density, and/or uniform density distribution (e.g. along the cone axis) of the smokeable product across all cones held in the pallet, and across cones in different pallets.

Referring to FIG. 4, in the example illustrated, the unload end 122 is movable between an advanced position and a retracted position. When in the advanced position (shown in FIG. 4), the unload end 122 is positioned over the dosing tray 126 for unloading the smokeable product into the sleeves 128. When in the retracted position, the unload end 122 is clear of the dosing tray 126 (and the pallet 104) for servicing, removing, and/or replacing the dosing tray 126 and/or the pallet 104. In the example illustrated, the second chute segment 154 includes a movable spout 180 comprising the unload end 122, and the spout 180 is movable (e.g. pivotable) between the advanced and retracted positions.

Figure 10:
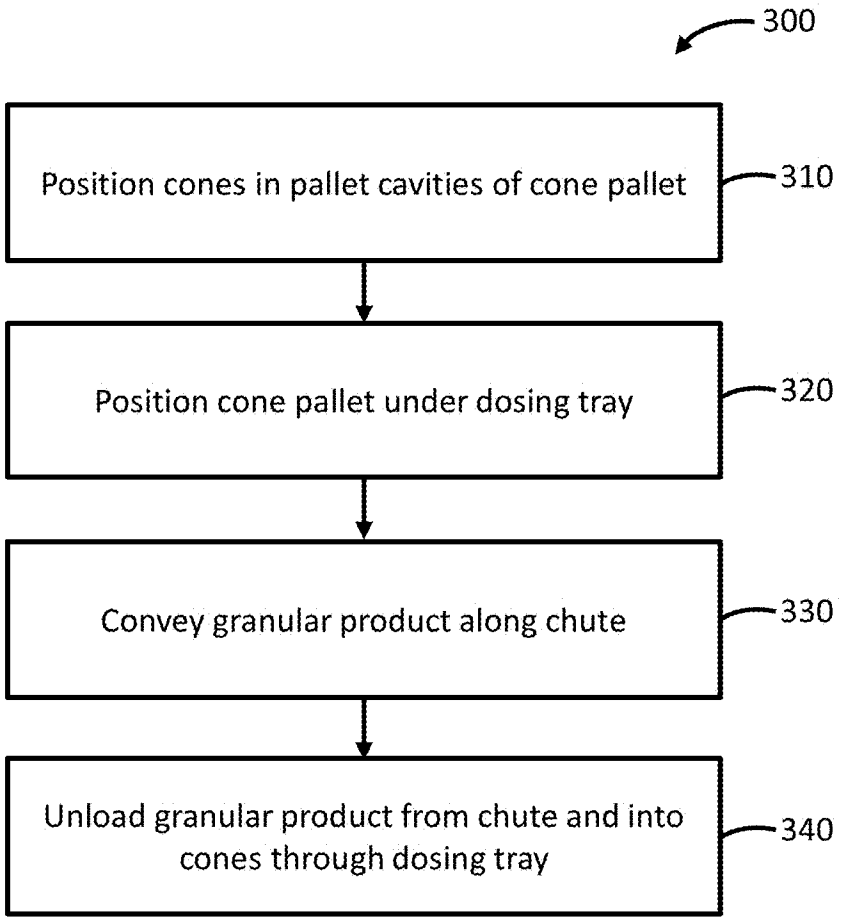
FIG. 10 is a flow chart showing an example process for production of conical smoking articles using an apparatus like that of FIG. 4.

Referring to FIG. 10, an example process 300 for production of smoking articles using the cone filling apparatus 100 is shown. At step 310 of the process 300, a plurality of cones 12 are positioned in respective pallet cavities 106 of the cone pallet 104. At step 320, the cone pallet 104 is positioned under the dosing tray 126. At step 330, the smokeable product is conveyed along the chute 118 toward the unload end 122 positioned above the dosing tray 126. In the example illustrated, step 330 includes controllably flowing the smokeable product along the chute 118 to the unload end 122. In some examples, the smokeable product is conveyed along the chute 118 at least in part by gravitational force.

During step 330, granules of the smokeable product can be preferentially advanced based on granule size, and in some examples, larger granules are advanced ahead of smaller granules. During step 330 vibrations can be imparted to the chute 118. At least one of an amplitude and a frequency of the vibrations can be adjusted to facilitate a desired flow rate and/or preferential advancement of the smokeable product based on granule size.

During step 330, the smokeable product can be conveyed along a plurality of chute segments 150 of the chute 118, and the process 330 can further include vibrating a first one of the chute segments 150 at a first frequency and a first amplitude, and vibrating a second one of the chute segments 150 at a second frequency and a second amplitude. The second frequency can be different from the first frequency and/or the second amplitude can be different from the first amplitude. In some examples, at least one of the frequency and amplitude of each of a plurality of the chutes are adjusted to achieve at least one of a preferential particle conveyance and a target fill time to fill all of the cones. In some examples, the target fill time is about 60 seconds.

At step 340 of the process 300, the smokeable product is unloaded from the unload end 122 of the chute 118 and into the cones 12 through the transfer sleeves 128 of the dosing tray 126. During step 340, the dosing tray 126 and the cone pallet 104 can be rotated about the vertical axis 107 to facilitate generally equal dispersion of the smokeable product among the pallet cavities 106.

In some examples, rotation of the dosing tray and the cavity pallet is synchronized with a rate at which the smokeable product is unloaded from the chute 118 such that the dosing tray 126 rotates an integer multiple of times while receiving one batch amount of the smokeable product from the unload end of the chute. The batch amount is equal to an amount of smokeable product required to fill all the cones 12 in the cone pallet 104.

Step 340 can further include: (i) partially filling a first cone 12 in the pallet 104 with a first amount of the smokeable product; (ii), after (i), partially filling a second cone 12 in the pallet 104 with the smokeable product; and (iii), after (ii), depositing a second amount of the smokeable product into the first cone 12 on top of the first amount. The first amount of the smokeable product can have a first average granule size, and the second amount of the smokeable product can have a second average granule size. In some examples, the second average granule size is smaller than the first average granule size.

The method 300 can further include the step of loading the chute 118 with one batch amount of the smokeable product and unloading the batch amount from the unload end 122 of the chute 118 in step 340, prior to loading a subsequent batch amount on the chute 118. The batch amount is equal to an amount of smokeable product required to fill all the cones 12 in the cone pallet 104.

In some examples, step 310 of the process 300 can include positioning the pallet 104 at a cone staging station to facilitate the staging step 55 of the process 50 (FIG. 3). At the cone staging station, a cone 12 is transferred into each empty pallet cavity 106 of the pallet 104. Step 320 can include, after each cavity 106 of the pallet 104 has received a respective cone 12, moving the pallet 104 from the cone staging station to a cone filling station to facilitate the filling step 60 of the process 50 (FIG. 3). At the cone filling station each cone 12 can be filled with the smokeable product using the apparatus 100 according to steps 320 to 340 of the process 300.

After each cone 12 in the pallet 104 is filled, the filled pallet 104 can be moved from under the dosing tray 126, and another pallet 104 holding empty cones 12 can be positioned under the dosing tray 118 for filling the empty cones with the smokeable product. Replacing the filled pallet 104 with a pallet 104 having empty cones can include removing the dosing tray 126 from the chamber 103*a*. The dosing tray 126 can be removed by operating the crank 144 to loosen the dosing tray 126 from the pallet 104. When loosened, the dosing tray 126 can be lifted out of the chamber 103*a*, and this step can be facilitated by moving the unload end 122 of the chute 118 clear of the chamber 103*a*. The filled cone pallet 104 can then be removed from the chamber 103*a*, a cone pallet with empty cones can be positioned in the chamber 103*a*, and the dosing tray 126 can be mounted atop the cone pallet with empty cones and tightened via the crank 144.

The filled pallet 104 can be moved to a cone compaction station to facilitate the compacting step 65 of the process 50 (FIG. 3). At the compacting station, the smokeable product in the cones 12 is compacted. After the smokeable product is compacted, the pallet 104 can be moved to a cone closure station to facilitate the closing step 70 of the process 50 (FIG. 3). At the cone closure station, an upper portion of each cone is twisted to close the open upper end of each cone.

Figure 11:
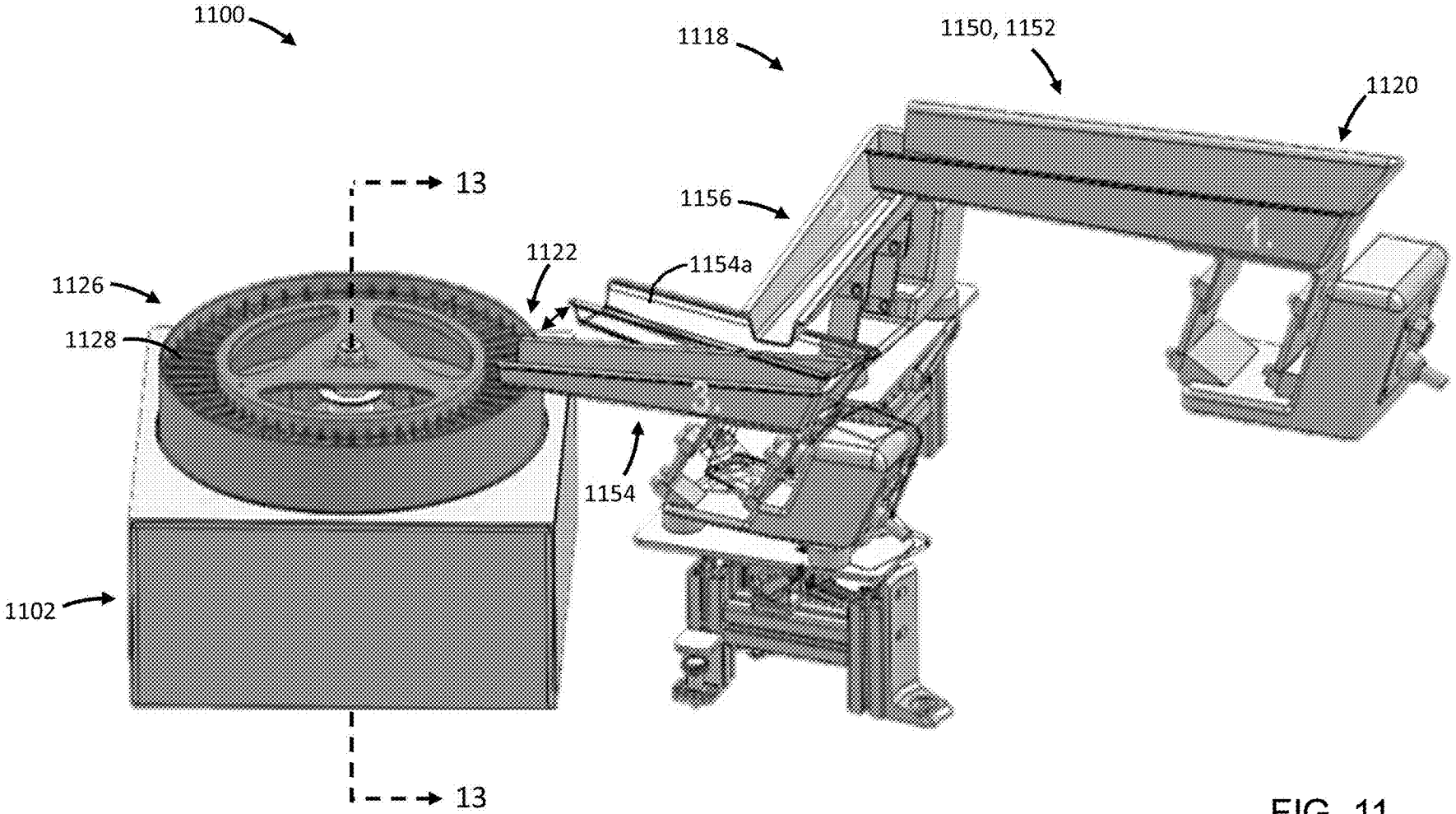
FIG. 11 is a perspective view of another example cone filling apparatus.
Figure 13:
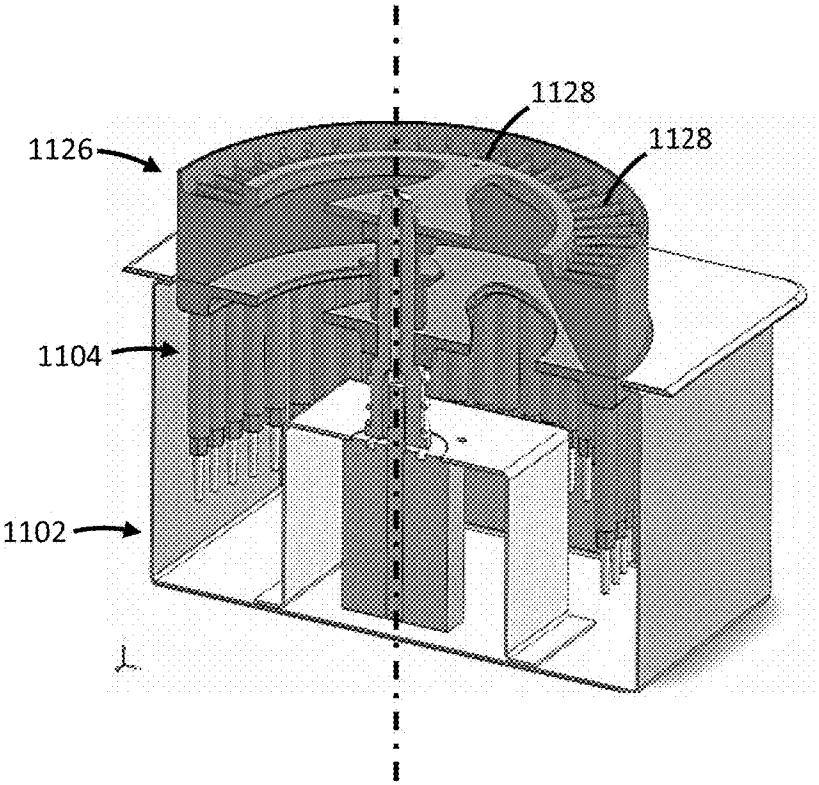
FIG. 13 is a cross-sectional view of the dosing portion of FIG. 12, taken along line 13-13 of FIG. 11.
Figure 12:
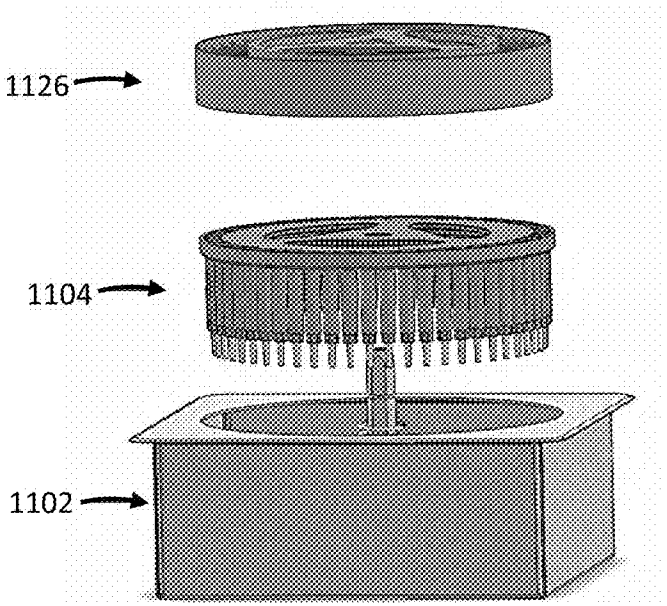
FIG. 12 is an exploded view of a dosing portion of the apparatus of FIG. 11.

Referring to FIGS. 11 to 13, another example cone filling apparatus 1100 is shown. The cone filling apparatus has similarities to the apparatus 100, and like features are identified with like reference characters, incremented by 1000. In the example illustrated, the apparatus 1100 includes a frame 1102, a cone pallet 1104 (FIGS. 12 and 13) having a plurality of pallet cavities for holding cones, a delivery chute 1118 having a load end 1120 and an unload end 1122, and a dosing tray 1126 disposed above the pallet 1104 and having a plurality of transfer sleeves 1128. In the example illustrated, the chute 1118 includes a plurality of chute segments 1150 including a first chute segment 1152 having the load end 1120, a second chute segment 1154 downstream of the first chute segment 1152 and having the unload end 1122, and a third chute segment 1156 intermediate the first chute segment 1152 and the second chute segment 1154.

The second chute segment 1152 is, in the example illustrated, pivotable about a generally vertical axis between a deployed position (shown at arrow 1154) and a stowed position (shown at 1154*a* in FIG. 11). In the stowed position, the unload end 1122 of the second chute 1154 is moved clear of the space above the tray 1126, which can facilitate access to the frame 1102 for removal of a filled pallet and insertion of an empty pallet 1104.

In the deployed position, the second chute 1154 is aligned generally orthogonal to the direction of the flow of product received from the third (intermediate) chute 1156. This change in flow direction can help to break up any clumps of product leaving the third chute 1156. In the example illustrated, the third chute 1156 is also oriented generally orthogonal to direction of the flow of product received by the third chute 1156 from the first chute 1152, which can also aid in breaking up any clumps of product leaving the first chute 1152. The relative orthogonal orientation of the third chute 1156 relative to the first and second chutes 1152, 1154 can also help to reduce the overall length of the apparatus 1100, making the apparatus more compact.

While described with respect to the cone 12, the apparatuses and methods disclosed herein may be adapted for use with smoking articles of a variety of shapes and sizes, including cones having a lower draft and/or cylindrical tubes.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A cone filling apparatus for production of smoking articles, comprising:

a. a cone pallet comprising a pallet body and including a plurality of cavities that are either (i) of unitary, integral construction with the pallet body or (ii) each defined by a respective nest attached to the pallet body, each cavity for holding a respective cone;

b. a delivery chute having a load end for receiving a smokeable product from a source and an unload end downstream of the load end for unloading the smokeable product from the chute; and c. a dosing tray disposed above the pallet, the dosing tray comprising a plurality of transfer sleeves, each sleeve having an upper sleeve end for receiving smokeable product unloaded from the unload end of the chute, and a lower sleeve end for dispensing the smokeable product into a cone held in a respective cavity aligned beneath the lower sleeve end, wherein the cone pallet is configured for releasable connection to the dosing tray.

2. The apparatus of claim 1, wherein the chute is configured to provide a controlled flow of the smokeable product to the dosing tray.

3. The apparatus of claim 1, wherein the chute comprises an inner chute surface for conveying the smokeable product, and a plurality of prongs adjacent the inner chute surface for inhibiting consolidation of the smokeable product.

4. The apparatus of claim 1, wherein the load end is at an elevation greater than the unload end to facilitate transport of smokeable product along the chute by gravitational force.

5. The apparatus of claim 1, wherein the chute comprises at least a first chute segment and a second chute segment downstream of the first chute segment, the first chute segment comprising the load end and the second chute segment comprising the unload end.

6. The apparatus of claim 5, wherein the chute comprises a third chute segment intermediate the first chute segment and the second chute segment.

7. The apparatus of claim 6, wherein the third chute segment has a third segment upstream end for receiving product from the first chute segment and a third segment downstream end for delivering product to the second chute segment.

8. The apparatus of claim 5, wherein one of the chute segments is inclined at a first angle from the horizontal and another one of the chute segments is inclined at a second angle from the horizontal, the second angle different from the first angle.

9. The apparatus of claim 1, wherein the chute is sized to receive one batch amount of the smokeable product, the batch amount equal to an amount of product required to fill all the cones in the cone pallet.

10. The apparatus of claim 1, wherein the chute is configured to preferentially advance product granules by size.

11. The apparatus of claim 10, wherein the chute is configured to advance larger granules ahead of smaller granules.

12. The apparatus of claim 1, further comprising a vibratory drive operable to urge vibration of the chute.

13. The apparatus of claim 12, wherein the vibratory drive has an adjustable frequency and amplitude, the frequency and amplitude tunable to facilitate a desired flow rate and preferential advancement of the smokeable product based on granule size along the chute.

14. The apparatus of claim 1, wherein the plurality of transfer sleeves and the plurality of cavities are of equal quantity.

15. The apparatus of claim 1, wherein the dosing tray includes a collection chamber above the transfer sleeves for receiving the product from the unload end of the chute and facilitating dispersion of the product among the transfer sleeves.

16. The apparatus of claim 1, wherein the lower ends of the transfer sleeves are simultaneously aligned with open upper ends of the respective cavities.

17. The apparatus of claim 1, wherein each of the plurality of cavities and the plurality of transfer sleeves are arranged about a vertical axis in a circular array, and the apparatus further comprises a rotary drive for rotating the dosing tray about the vertical axis.

18. The apparatus of claim 17, wherein the cone pallet is releasably coupled to the dosing tray to rotate with the dosing tray and maintain alignment of the transfer sleeves and the cavities.

19. The apparatus of claim 17, wherein rotation of the dosing tray is synchronized with a rate at which product is dispensed from the unload end of the chute such that the dosing tray rotates an integer multiple of times while receiving one batch of the smokeable product from the unload end, the one batch equal to an amount of product required to fill all the cones in the cone pallet.

20. The apparatus of claim 1, wherein each cavity is defined by an inner surface extending between an open upper end and a lower end, and wherein the inner surface tapers radially inward from the upper end to the lower end.

21. The apparatus of claim 1, wherein each nest is removably secured to the pallet body.

22. A cone filling apparatus for production of smoking articles, comprising:

a delivery chute comprising a plurality of chute segments including at least:

a first chute segment comprising a load end configured to receive a smokeable product from a source, the first chute segment being adjustable with respect to at least one of angle from horizontal, vibration frequency, or vibration amplitude; and a second chute segment downstream of the first chute segment and configured to receive the smokeable product from the first chute segment, the second chute segment comprising an unload end configured to unload the smokeable product from the delivery chute, the second chute segment being independently adjustable from the first chute segment with respect to at least one of angle from horizontal, vibration frequency, or vibration amplitude;

a dosing tray comprising a plurality of transfer sleeves, each sleeve having an upper sleeve end configured to receive the smokeable product from the unload end of the second chute segment, and a lower sleeve end; and a cone pallet including a plurality of cavities, each cavity aligned beneath the lower sleeve end of one of the transfer sleeves, and each cavity configured to hold a cone in a manner that smokeable product dispensed from one of the transfer sleeves is receivable in the cone.

23. The apparatus of claim 22, wherein a pair of adjacent chute segments are vertically spaced from each other such that the smokeable product falls vertically after exiting one of the chute segments and before being received by another of the chute segments.

24. The apparatus of claim 22, wherein a pair of adjacent chute segments are positioned generally orthogonal to each other.

25. The apparatus of claim 22, wherein at least one of the plurality of chute segments comprises an inner chute surface configured to convey the smokeable product, and further comprising a plurality of prongs adjacent the inner chute surface, the plurality of prongs configured to inhibit consolidation of the smokeable product.

26. The apparatus of claim 22, wherein the plurality of chute segments includes a third chute segment intermediate the first chute segment and the second chute segment.

27. The apparatus of claim 26, wherein the third chute segment has an upstream end for receiving product from the first chute segment and a downstream end for delivering product to the second chute segment.

28. The apparatus of claim 22, wherein one of the chute segments is inclined at a first angle from horizontal and another one of the chute segments is inclined at a second angle from horizontal, the second angle different from the first angle.

29. The apparatus of claim 22, further comprising a vibratory drive operable to vibrate at least one of the chute segments.

30. The apparatus of claim 29, wherein the vibratory drive has an adjustable frequency and amplitude, the frequency and amplitude tunable to facilitate a desired flow rate and preferential advancement of the smokeable product based on granule size along the chute.

31. The apparatus of claim 29, wherein the vibratory drive is operable to vibrate the first chute segment, and further comprising a second vibratory drive operable to vibrate the second chute segment independent from the first chute segment.

32. The apparatus of claim 31, wherein the first vibratory drive is operable to vibrate the first chute segment at a first vibration frequency and a first vibration amplitude, and wherein the second vibratory drive is operable to vibrate the second chute segment at a second vibration frequency and a second vibration amplitude.

33. The apparatus of claim 32, wherein the first chute segment is pivotable about a first pivot axis to adjust a first angle of the first chute segment from horizontal, and wherein the second chute segment is pivotable about a second pivot axis to adjust a second angle of the second chute segment from horizontal, wherein the first angle is adjustable independently from the second angle.

34. The apparatus of claim 22, wherein the first chute segment is pivotable about a first pivot axis to adjust a first angle of the first chute segment from horizontal, and wherein the second chute segment is pivotable about a second pivot axis to adjust a second angle of the second chute segment from horizontal, wherein the first angle is adjustable independently from the second angle.

35. The apparatus of claim 22, wherein the cone pallet comprises a pallet body and the plurality of cavities are arranged in a circular array about a vertical axis of the pallet body.

36. The apparatus of claim 35, wherein the cone pallet is configured for releasable connection to the dosing tray.

* * * * *